US010900288B2

(12) United States Patent
Shen et al.

(10) Patent No.: US 10,900,288 B2
(45) Date of Patent: Jan. 26, 2021

(54) SLIDE DRILLING SYSTEM AND METHOD

(71) Applicant: Schlumberger Technology Corporation, Sugar Land, TX (US)

(72) Inventors: Yuelin Shen, Spring, TX (US); Sujian Huang, Beijing (CN); Cesar Pena, Katy, TX (US); Oney Erge, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 285 days.

(21) Appl. No.: 15/579,337

(22) PCT Filed: Jun. 3, 2016

(86) PCT No.: PCT/US2016/035604
§ 371 (c)(1),
(2) Date: Dec. 4, 2017

(87) PCT Pub. No.: WO2016/196853
PCT Pub. Date: Dec. 8, 2016

(65) Prior Publication Data

US 2018/0355669 A1 Dec. 13, 2018

(30) Foreign Application Priority Data

Jun. 5, 2015 (WO) ..... PCT/CN2015/080911

(51) Int. Cl.
*E21B 7/24* (2006.01)
*E21B 7/06* (2006.01)
*E21B 45/00* (2006.01)

(52) U.S. Cl.
CPC ..... *E21B 7/24* (2013.01); *E21B 7/06* (2013.01); *E21B 45/00* (2013.01)

(58) Field of Classification Search
CPC ..... G06G 7/48; G05B 19/02; G06F 19/00; G16Z 99/00; E21B 7/24; E21B 7/06;
(Continued)

(56) References Cited

U.S. PATENT DOCUMENTS 4,312,223 A 1/1982 Koch
5,310,014 A 5/1994 Mueller
(Continued)

FOREIGN PATENT DOCUMENTS

WO 2013076184 A2 5/2013
WO 2015051027 A1 4/2015

OTHER PUBLICATIONS

International Search Report and Written Opinion issued in International Patent application PCT/US2016/035604, dated Sep. 12, 2016. 16 pages.
(Continued)

*Primary Examiner* — George S Gray
(74) *Attorney, Agent, or Firm* — Alec J. McGinn

(57) ABSTRACT

Systems, methods, and computer-readable media for drilling. The method includes receiving a drilling model of a drilling system including a drill string, selecting a frequency and amplitude for axial vibration of the drill string based on the drilling model, and generating the axial vibration substantially at the frequency and the amplitude selected by modulating a hookload or axial movement at a surface of the drill string.

20 Claims, 7 Drawing Sheets

(58) Field of Classification Search
CPC ..... E21B 45/00; E21B 44/00; E21B 47/04; E21B 47/00; E21B 47/006
See application file for complete search history.

(56) References Cited

U.S. PATENT DOCUMENTS

| | | | | |
|---|---|---|---|---|
| 5,540,295 | A | 7/1996 | Serrette | |
| 6,338,390 | B1 * | 1/2002 | Tibbitts | E21B 7/24 175/381 |
| 6,796,390 | B1 | 9/2004 | Bakker | |
| 8,798,978 | B2 | 8/2014 | Ertas et al. | |
| 2005/0236190 | A1 | 10/2005 | Walter | |
| 2010/0139912 | A1 * | 6/2010 | Pfahlert | E21B 7/24 166/177.6 |
| 2011/0186353 | A1 | 8/2011 | Turner et al. | |
| 2013/0126241 | A1 | 5/2013 | Boone et al. | |
| 2013/0146360 | A1 * | 6/2013 | Yajure | E21B 7/24 175/55 |
| 2015/0023137 | A1 * | 1/2015 | Benson | E21B 7/06 367/82 |
| 2015/0083493 | A1 * | 3/2015 | Wassell | E21B 49/003 175/40 |

OTHER PUBLICATIONS

International Search Report and Written Opinion issued in International Patent application PCT/CN2015/080911, dated Feb. 18, 2016. 12 pages.

* cited by examiner

SLIDE DRILLING SYSTEM AND METHOD

CROSS-REFERENCE TO RELATED APPLICATIONS

This application claims priority to PCT Patent Application No. PCT/CN2015/080911, which was filed on Jun. 5, 2015, and is hereby incorporated by reference in its entirety.

BACKGROUND

In oilfield drilling operations, a drill string is deployed into the Earth to form a wellbore. The drill string is typically rotated, in order to rotate the drill bit of the bottom-hole assembly (BHA) at the end of the drill string. However, at some points during drilling, the drill string may be operated in a "sliding mode," in which at least a portion of the drill string is not rotating, while a mud motor or another device is employed to rotate the drill bit.

Sliding mode drilling is used, for example, in the creation of deviated wellbores, e.g., moving from vertical to horizontal. However, sliding mode presents challenges, one of which is the friction forces between the drill string and the wellbore. To reduce such friction forces, vibration of the drill string is sometimes employed. This vibration may take the form of "rocking" the drill string at the surface, generally by applying torque in one rotational direction, and the in the opposite direction. This technique may also be employed to control a toolface orientation. The vibration may also be axial, generally introduced by a valve in the drill string that is modulated, and thereby creates pressure pulses in the drill string. The pressure pulses then cause the axial vibration.

These techniques and others have been successfully employed. However, the downhole tools (e.g., valves) that create axial vibration are active throughout drilling, while sliding mode drilling may be a small fraction of the drilling time. This may result in wasted energy and a reduction in tool life. Further, increased toolface orientation control and reductions in pipe sticking during sliding mode would be welcome additions.

SUMMARY

Embodiments of the disclosure may provide a method for drilling. The method includes receiving a drilling model of a drilling system including a drill string, selecting a frequency and amplitude for axial vibration of the drill string based on the drilling model, and generating the axial vibration substantially at the frequency and the amplitude selected by modulating a hookload or axial movement at a surface of the drill string.

In some embodiments, selecting the frequency and amplitude includes selecting a frequency and amplitude for oscillations of weight-on-bit.

In some embodiments, the method further includes measuring a performance characteristic while generating the axial vibration, selecting a second frequency and a second amplitude, generating the axial vibration at the second frequency and second amplitude, measuring the performance characteristic while generating the axial vibration at the second frequency and the second amplitude, and determining whether to adjust the frequency, the amplitude, or both based on the performance characteristic.

In some embodiments, the method further includes determining a first toolface orientation for the drill string before generating the axial vibration, determining a second toolface orientation for the drill string after generating the axial vibration, and adjusting the frequency, amplitude, or both of the axial vibration based on a difference between the first and second toolface orientations.

In some embodiments, the method also includes calculating a hookload maximum and minimum for the drilling system based on the drilling model, and determining an envelope for the frequency and amplitude of the axial vibration based on the hookload maximum and the hookload minimum.

In some embodiments, the method also includes determining that the drill string is in sliding mode, and determining that a bottom-hole assembly of the drill string is steering to a first direction. The axial vibration is generated in response to determining that the bottom-hole assembly of the drill string is steering to the first direction.

In some embodiments, the method further includes determining that the bottom-hole assembly is steering to a second direction, and in response to determining that the bottom-hole assembly is steering to the second direction, increasing the hookload.

Embodiments of the disclosure may also provide a system for drilling. The system includes a surface structure, a drilling device coupled to the surface structure, a drill string coupled to the drilling device and extending therefrom into a wellbore, a drawworks, a drilling line connected to the drawworks and the drilling device, such that the drawworks is configured to raise and lower the drilling device, and an actuator connected to the drilling line and the surface structure. The actuator is configured to vertically oscillate a position of the drilling device and cause axial vibration in the drill string. The system also includes a processor coupled to the actuator. The processor is configured to select a frequency and an amplitude for axial vibration in the drill string. Further, the processor transmits signals to the actuator, causing the actuator to generate the axial vibration in the drill string. In some embodiments, the processor may be configured to execute at least a portion of any of the embodiments of the method disclosed herein.

Embodiments of the disclosure may also include a non-transitory, computer-readable medium storing instructions that, when executed by at least one processor of a computing system, causing the computing system to perform operations. The operations include receiving a drilling model of a drilling system including a drill string, selecting a frequency and amplitude for axial vibration of the drill string based on the drilling model, and causing an actuator to generate the axial vibration substantially at the frequency and the amplitude selected by modulating a hookload or axial movement at a surface of the drill string. In some embodiments, the operations may include any of the embodiments of the method disclosed herein.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DESCRIPTION OF EMBODIMENTS

Figure 1:
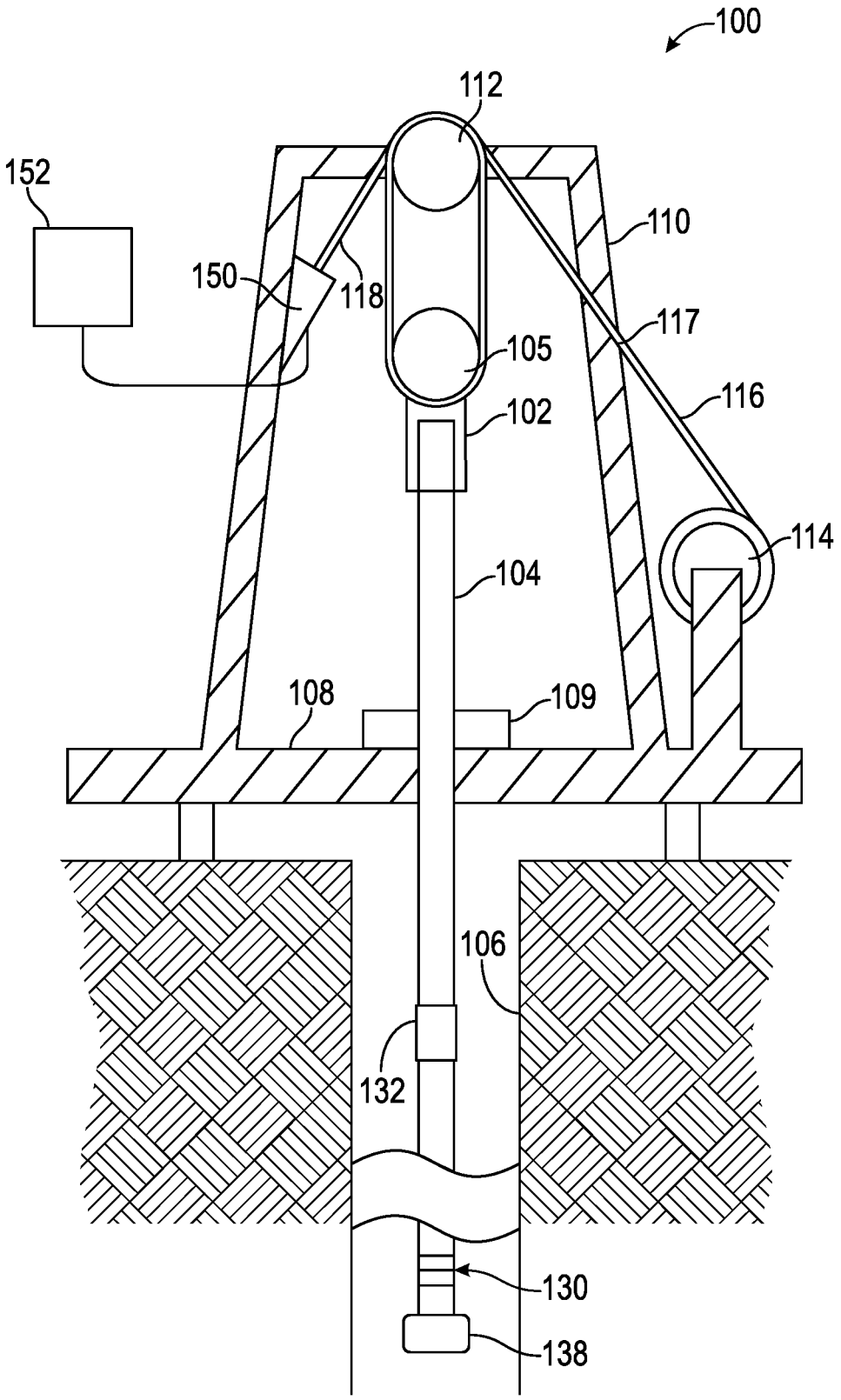
FIG. 1 illustrates a simplified, schematic view of a drilling system, according to an embodiment.

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object, and, similarly, a second object could be termed a first object, without departing from the scope of the invention. The first object and the second object are both objects, respectively, but they are not to be considered the same object.

The terminology used in the description herein is for the purpose of describing particular embodiments only and is not intended to be limiting. As used in the description of the invention and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques and workflows that are in accordance with some embodiments. Some operations in the processing procedures, methods, techniques and workflows disclosed herein may be combined and/or the order of some operations may be changed.

In general, embodiments of the present disclosure may provide for increasing drilling performance and/or correcting steering of the bottom-hole assembly by axially vibrating the drill string at the surface. Such axial vibrations may be generated by varying the hookload at the surface or introducing an axial movement pattern to the drill string at the surface. Further, the present methods may facilitate automation of oscillation of the weight on the surface to simulate or "re-establish" drilling conditions from an earlier part of a well into a later part. Accordingly, at least some embodiments of the present disclosure may allow for returning to a baseline drilling condition, in which drilling behavior has already been experienced, but in a different part of the well, by axially shaking the drill string. The effectiveness of this technique may be determined using the differential pressure detected by surface or downhole sensors.

Turning now to the specific, illustrated embodiments, FIG. 1 illustrates a side, schematic view of a drilling system 100, according to an embodiment. The drilling system 100 may include a surface structure 110 and a drilling device 102, from which a string of drill pipes (i.e., a drill string 104) may be deployed into a wellbore 106. The drilling device 102 may be, for example, a top drive, although any other type of drilling device may be employed. The drilling device 102 may be supported, in turn, by a travelling block 105, which may be movably connected to a crown block 112 located at a top of the surface structure 110 of the drilling device 102. The travelling block 105 and the crown block 112 may include pulleys, which may receive a drill line 116 therethrough, e.g., in a block-and-tackle arrangement. A fast line 117 of the drill line 116 may extend between the crown block 112 and a drawworks 114, and may be spooled on the drawworks 114. The drawworks 114 may be rotated to raise or lower the travelling block 105 and thus the drilling device 102, relative to a rig floor 108. Further, a dead line 118 of the drill line 116 extends from the crown block 112, e.g., opposite to the fast line 117, and may be connected to the surface structure 110, rig floor 108, or another location. The drilling system 100 may also include a slips assembly 109, which may support the drill string 104 proximal to the rig floor 108, allowing the drilling device 102 to be disconnected from the drill string 104.

The drill string 104 may include a bottom-hole assembly (BHA) 130, which may include a drill bit 138. The BHA 130 may also include several other devices, such as a rotary steerable system (RSS), a measurement-while-drilling (MWD) device, a logging-while-drilling (LWD) device, and/or any other suitable device. Between the BHA 130 and the top connection of the drill string 104 (i.e., along its length at some point), the drill string 104 may include a vibrator or agitator tool 132. The tool 132 may provide a valve, diaphragm, etc., a shock sub, and/or any other suitable device to create an axial vibration in the drill string 104. For example, the tool 132 may generate pressure pulses in the drilling mud, thereby generating the axial vibration.

The drilling system 100 may also include an actuator 150 and a processor 152 connected thereto. The processor 152 may be configured to transmit signals to the actuator 150. In response to these signals, the actuator 150 may be configured to expand or contract, or otherwise vary the effective length of the drill line 116, so as to change the vertical position of the travelling block 105 and thus the drilling device 102. This, in turn, may generate axial vibration in the drill string 104. The processor 152 may be operable to control such vibration generation, e.g., through execution of one or more embodiments of the methods described below. In some embodiments, the actuator 150 may be attached to the dead line 118 and/or to the surface structure 110, but in other embodiments, the actuator 150 may be positioned elsewhere. Further, the actuator 150 may be a hydraulic cylinder or another type of device.

Figure 2:
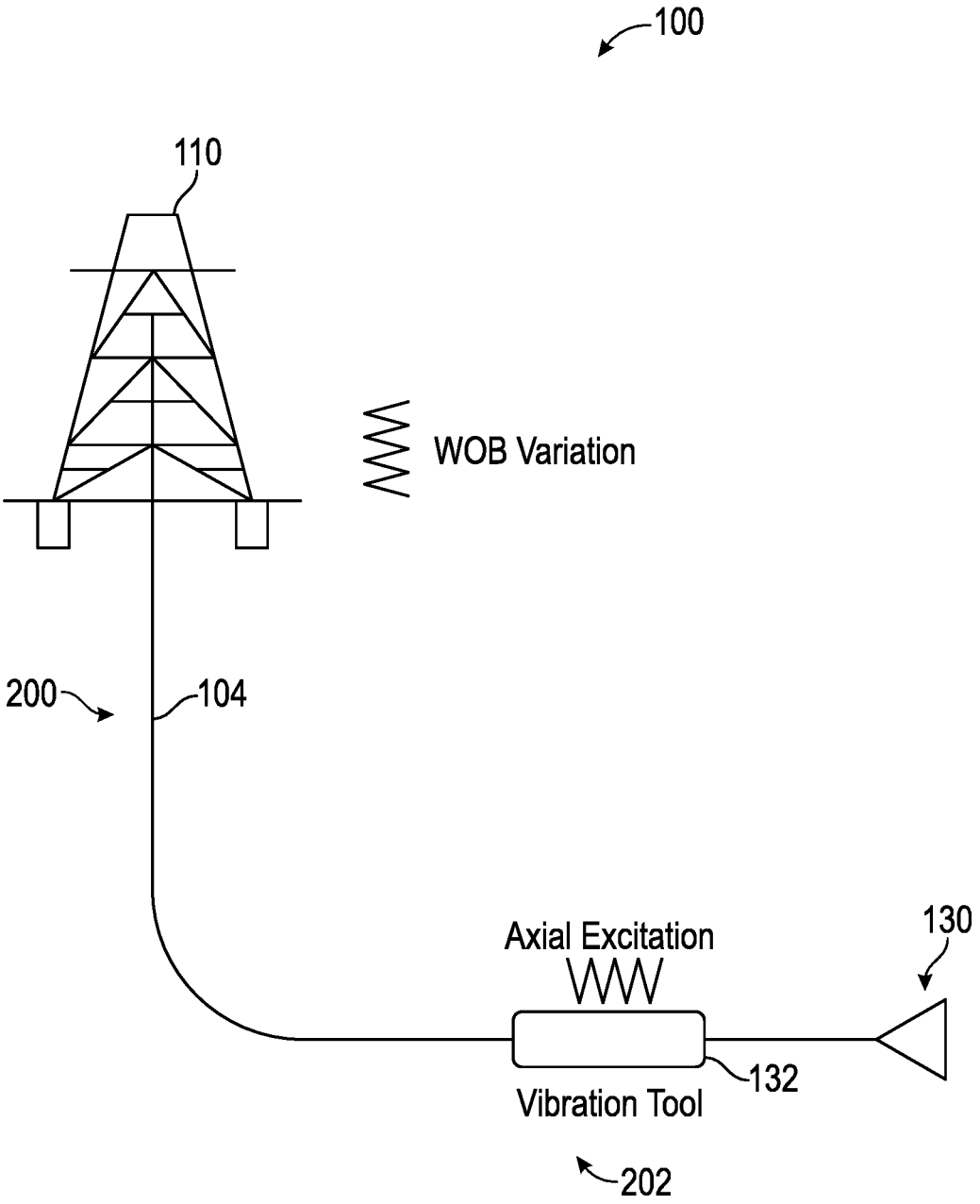
FIG. 2 illustrates another simplified, schematic view of the drilling system, according to an embodiment.

With continuing reference to FIG. 1, FIG. 2 illustrates another schematic view of the drilling system 100. As shown, the drill string 104 extends from a vertical section 200 to a horizontal section 202. The tool 132 may be positioned so as to vibrate the drill string 104 in the horizontal section 202, as shown. Further, the drilling system 100 may also vibrate the drill string 104 at or near the surface structure 110. For example, the drilling device 102 (or another torquing device) may apply a periodic torque on the drill string 104, which may cause radial vibration. Further, a periodic force may be applied to the drill line 116, e.g., the dead line 118, thereby increasing and decreasing the hookload. In an embodiment, this may be accomplished using a hydraulic cylinder attached to the dead line 118. The periodic varying of the hookload may induce an axial vibration in the drill string 104, which may increase performance (e.g., the rate of penetration (ROP) of the drill bit 138), enhance weight transfer downhole onto the bit (i.e., increase average weight-on-bit (WOB)) and adjust the toolface orientation, as will be described in greater detail below.

Figure 3:
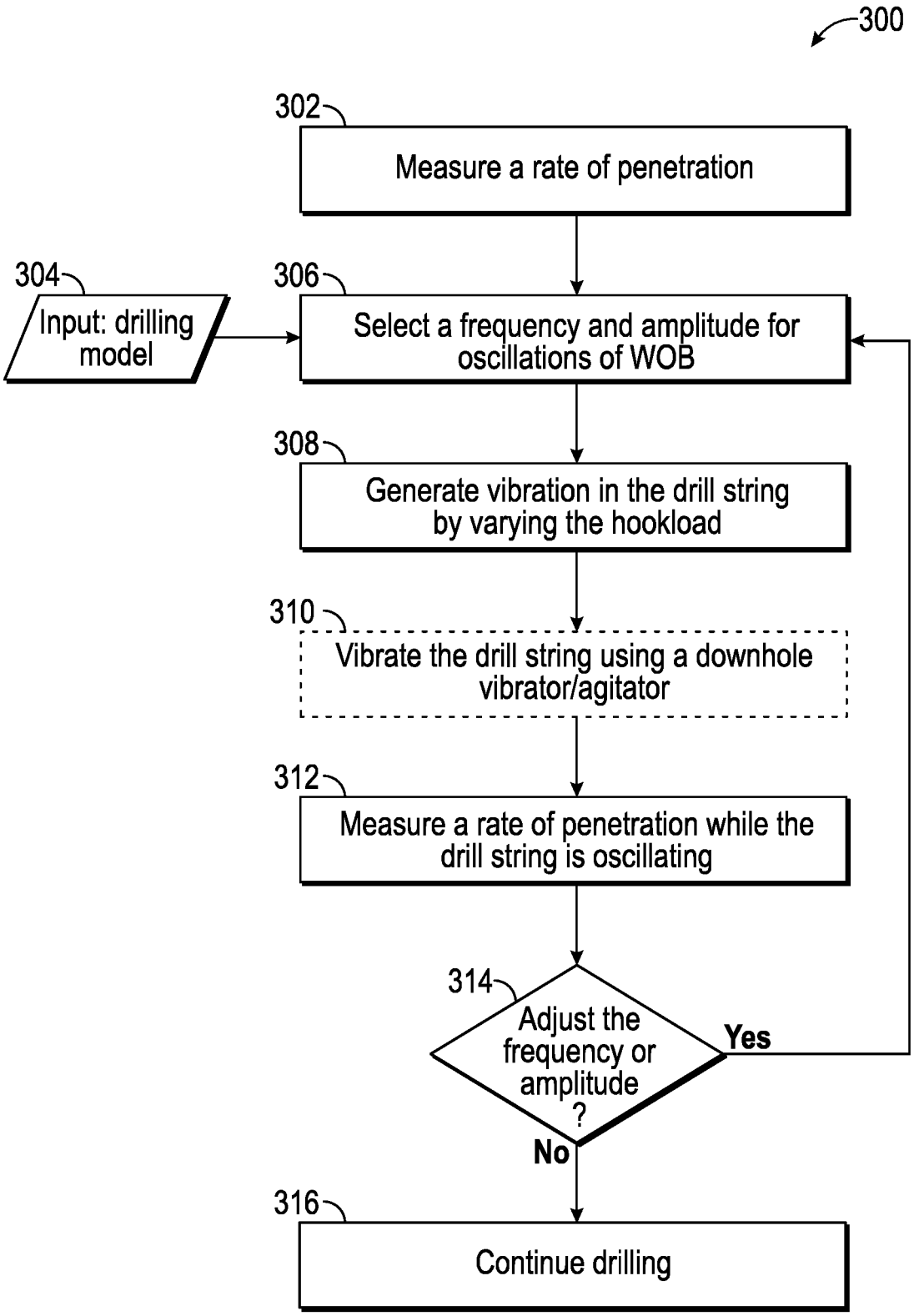
FIGS. 3, 4, 5, and 6 illustrate flowcharts of methods for drilling, according to several embodiments.

FIG. 3 illustrates a flowchart of a method 300 for drilling a wellbore, according to an embodiment. In some embodiments, the method 300 may be executed using the drilling system 100, and thus is described herein with reference thereto; however, in other embodiments, other types of drilling systems may be employed consistent with the method 300.

The method 300 may begin with measuring a performance parameter, such as the rate of penetration (ROP), as shown at 302. This may serve as a baseline measurement, from which increased performance may be measured. The method 300 may also receive, as input, a drilling model, as at 304. The drilling model may account for physical characteristics of the drilling system 100 and/or the wellbore 106. For example, the drilling model may include data representing the equipment of the drilling system 100, the diameter of the wellbore 106, formation properties, mud properties, etc.

Based on the model, the method 300 may include selecting a frequency and amplitude for oscillations of the weight-on-bit (WOB), as at 306. The frequency and amplitude for the WOB may be determined based on increasing the performance parameter, e.g., based on simulations conducted using the model.

The method 300 may then proceed to generating vibrations in the drill string by varying the hookload, as at 310. The vibrations generated may induce the oscillations in the WOB selected at 306. Accordingly, the method 300 may include using the model to translate frequency and amplitude of hookload variations into WOB variation, taking into account, for example, the physics of the extended length of pipe of the drill string 104. The frequency and amplitude of the hookload variations may also take into account a range of frequency and amplitudes that are within a design envelope of the drilling system 100, to avoid damaging the system 100, and to select a setpoint that the system 100 is capable of creating.

Further, in some examples, the method 300 may include generating vibrations in the drill string 104 using the downhole vibrator/agitation (e.g., the tool 132 of FIGS. 1 and 2), as at 310. Vibrations generated using the tool 132 may originate as pressure pulses in a pump at the surface. For example, the pump may generate pressure pulses in the drilling fluid, which may interact with a choke in the tool 132. The choke may convert at least some of the energy of the pressure pulses into axial force. The pressure pulses may thus be employed to generate vibration downhole. The amplitude and frequency of the vibration generated by the pulses may be configured to interfere, constructively or destructively, with vibrations generated by oscillating the hookload or axial position of the drilling device 102, and/or in some cases, may be employed independent of the hookload-induced vibrations. Thus, the tool 132 may be configured to work in combination with the vibrations induced by the variations in hookload, and vice versa. Accordingly, the frequency and amplitude of vibrations generated at the surface may be calculated with the frequency and amplitude of the vibrations generated by the tool 132, to arrive at a combined, induced vibration in the drill string 104. In other embodiments, the tool 132, and thus the block 310, may be omitted.

The method 300 may then include measuring the ROP when the drill string 104 is vibrating, as at 312. This may be compared to the initially-determined ROP at 302, to determine the effect of the axial vibrations.

The method 300 may also tune the frequency and amplitude of the vibrations, e.g., iteratively. Accordingly, the method 300 may determine whether to adjust the frequency or amplitude, as at 314. In some embodiments, this determination may be made by comparing the most-recently measured ROP (or another performance parameter) with the ROP measured prior to the most-recent frequency and/or amplitude adjustment. If the new ROP is higher than the previous ROP by greater than a threshold amount, the frequency and/or amplitude may be adjusted in order to seek the highest ROP, while remaining within the physical constraints of the system 100. Accordingly, if the determination at 314 is affirmative, the method 300 may select a new frequency at 306 and begin the next iteration. Otherwise, the method 300 may proceed with continuing to drill, as at 316.

Figure 4:
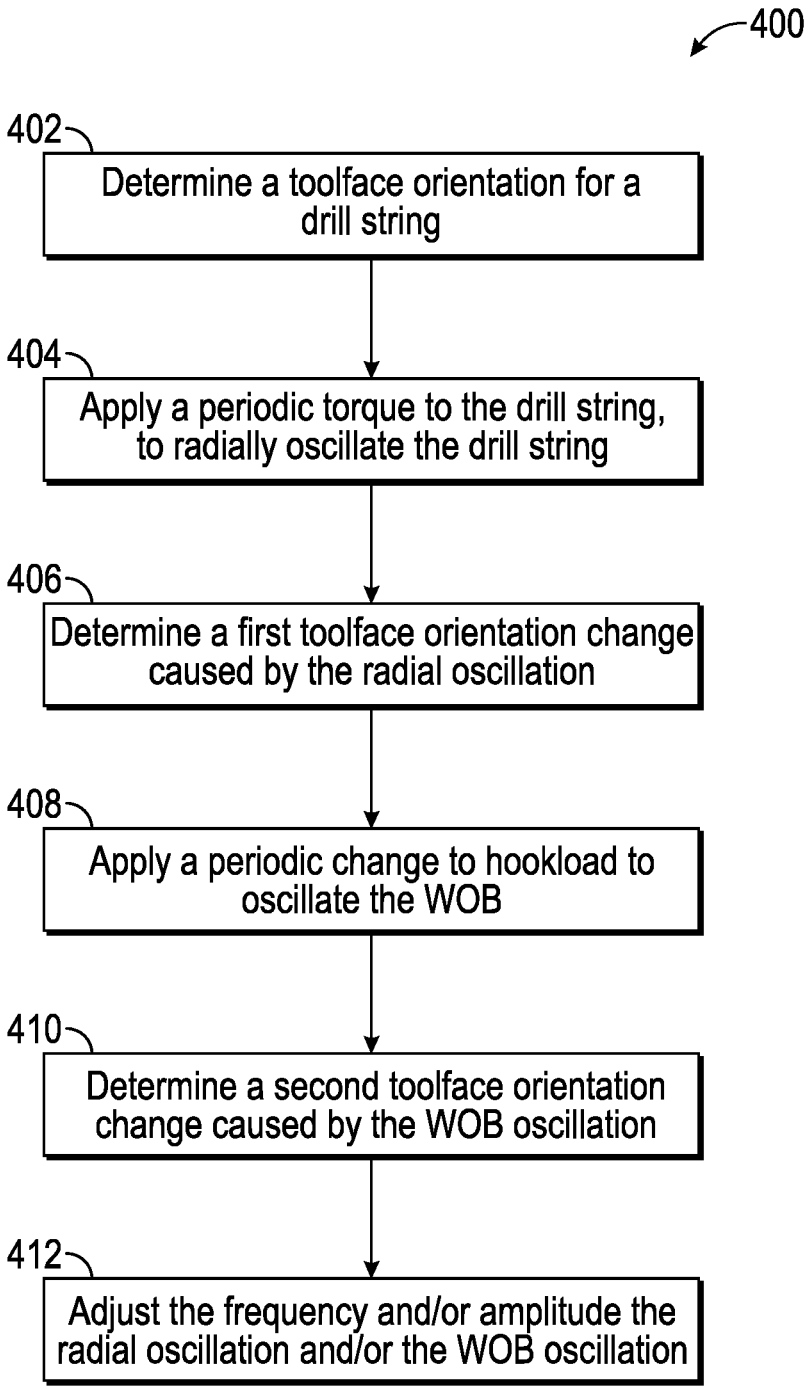

FIG. 4 illustrates a flowchart of another method 400 for drilling, according to an embodiment. In some embodiments, the method 400 may be executed using the drilling system 100, and thus is described herein with reference thereto; however, in other embodiments, other types of drilling systems may be employed consistent with the method 400.

The method 400 may including determining a toolface orientation, as at 402, e.g., using a survey. The method 400 may then include applying a periodic torque to the drill string 104, which may cause the drill string 104 to radially (i.e., in a circumferential direction) vibrate, as at 404.

The method 400 may then determine a first toolface orientation change caused by the radial oscillations, as at 406. This may be performed by conducting a second survey, and comparing the toolface orientation with the toolface orientation determined at 402.

The method 400 may also include applying a periodic change to hook load, to oscillate the WOB by creating axial vibrations in the drill string 104, as at 408, and determining a second toolface change caused by the WOB oscillations, as at 410. In some embodiments, one or the other of 404 and 408 may occur, and thus the "second" toolface orientation change does not necessarily imply the existence of a first toolface orientation change.

Further, the frequency and/or amplitude of either or both of the radial and axial vibrations may be adjusted, as at 412. For example, the first and/or second toolface orientation changes may be employed to correct a trajectory of the wellbore during drilling. Thus, the frequency and/or amplitude may be tuned one or more times to result in a desired toolface orientation change.

Figure 5:
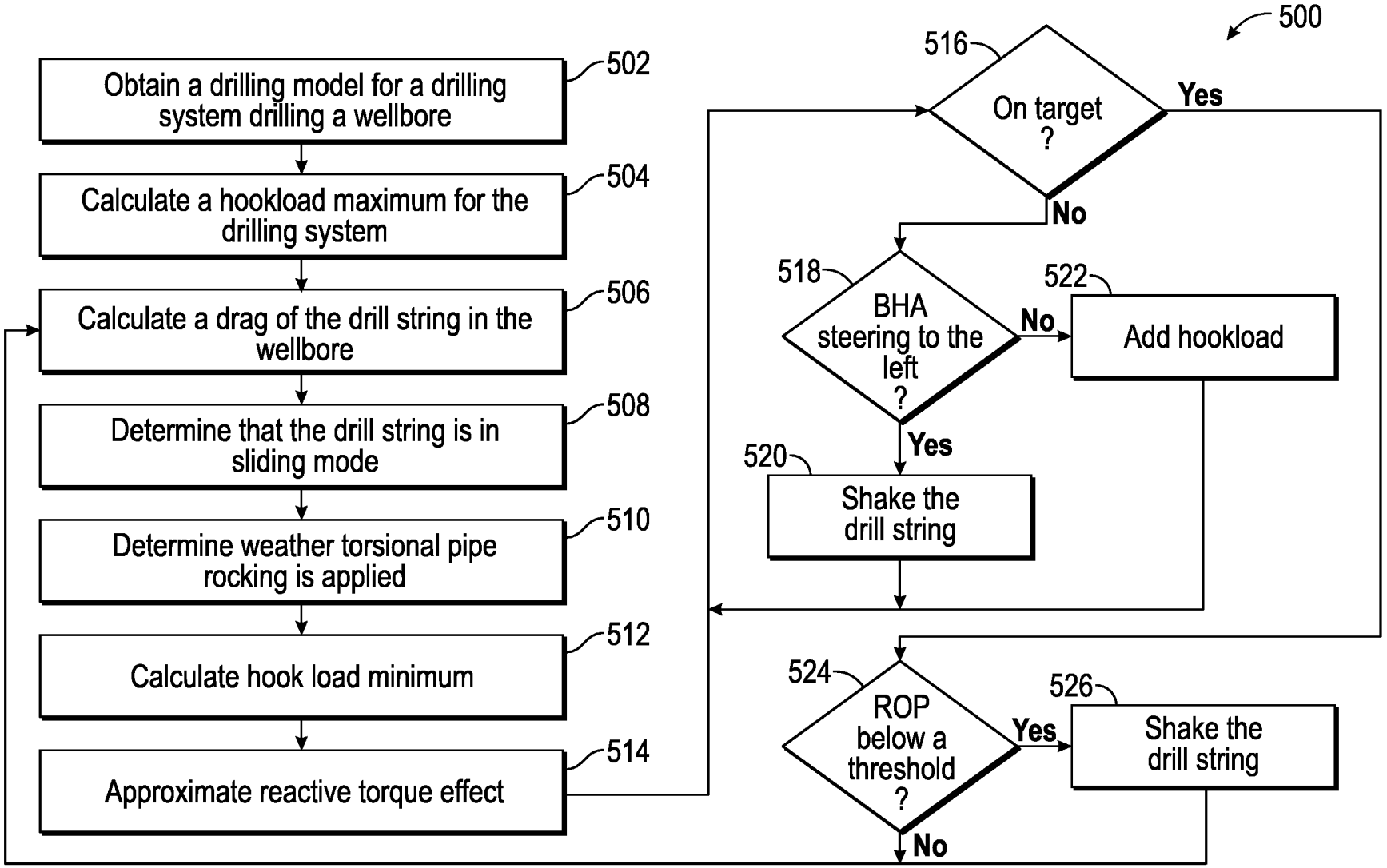

FIG. 5 illustrates another flowchart of a method 500 for drilling, according to an embodiment. In some embodiments, the method 500 may be executed using the drilling system 100, and thus is described herein with reference thereto; however, in other embodiments, other types of drilling systems may be employed consistent with the method 500.

The method 500 may include obtaining a drilling model for the drilling system 100 for drilling a wellbore, as at 502. Using the model, the method 500 may calculate a hookload maximum for the drilling system 100, as at 504. This may be based on physical constraints of the drilling system 100.

The method 500 may also include calculating a drag on the drill string 104 in the wellbore 106, as at 506. By way of explanation, frictional resistance to pipe movement is known as drag, and is responsible for various types of inefficiencies throughout the drilling process. Drag magnitude can be estimated by multiplying a friction coefficient by the cumulative contact forces between the drill-string and the wellbore wall and/or casing. The former may be determined based on a variety of factors, including the type of formation, mud composition, drill string design, well trajectory (tortuosity) and depth, WOB, or any others. Moreover, the friction coefficient may be higher prior to initiating drill-string movement. Rotating the drill-string without axial motion creates tangential drag which resists rotation of the same (this is manifested as surface torque). In other words, drag acts opposite to the direction of motion (axial, radial/tangential, et al). To that end, a rotating drill-string will be subjected to near frictionless axial motion if rotational speed is significantly greater than axial velocity, thereby facilitating movement of the drill-string in the forward and backward direction when drilling, reaming or tripping into the hole and back-reaming or tripping out of the hole respectively. When the relationship between rotation of the drill-string and axial movement of the same cannot be easily achieved or is irreversibly compromised, the process of shaking the drill-string in a systematic manner may be employed to carry out the plurality of the tasks associated with drilling and completing a well (rotary drilling, slide drilling, reaming and back reaming, tripping in and tripping out, etc.).

Moreover, if the drag is low, WOB can be transferred effectively to the bit and shaking of the drillstring may not facilitate drilling to a large degree, and thus the shaking motion may not be activated. When drag is high, however, shaking the drillstring can help reduce the drag to achieve efficient drilling, and avoid sudden WOB changes caused by variation of drag during sliding.

The method 500 may further include determining that the drill string is in sliding mode, as at 508. In some embodiments, the drill string 104 may be rotated during most of the drilling process. For example, when the BHA 130 is in the vertical section 200, the drill string 104 may be rotated by the drilling device 102. In such embodiments, "shaking" of the drill string 104, either axially or radially, may not be advantageous to the performance of the drilling process. Further, even in sliding mode, e.g., at the initial stages of the kick-off into a deviated section, the drag on the drill string 104, caused by the drill string 104 resting on the bottom of the wellbore 106 along its length, may be relatively low, and thus shaking the drill string 104 may also not be called for.

The method 500 may further include determining whether torsional pipe rocking is applied, as at 510. Torsional pipe rocking, e.g., by applying a torque in one direction, and then in an opposite direction, for a predetermined amount of time and/or number of rotations in either direction, may facilitate sliding mode drilling. Accordingly, the method 500 may account for the application of such radial vibrations induced by the application of such forces.

The method 500 may also include calculating the hookload minimum, as at 512. The link between surface WOB and actual force applied to the bit is a combination of the elastic properties of the drill string (weight, grade, etc.), rock strength, and the amount of drag acting on it. Under normal circumstances, this drag manifests in the form of torque, because the rotational speed of a drill string is much higher than the rate drill-string movement. This allows WOB to be minimally influenced by drag and to be related to the elastic properties of the drill string and rock strength. Minimum WOB can be inferred using the specifications and existing rock strength data. Empirical approaches, such as drill rate tests, may also or instead be used to determine the minimum WOB that is called for to fail any given type of rock for various rates of penetration cross-referenced against differential pressure if a motor is part of the drill string. Further, this calculation may include a determination of the differential pressure when the hookload is at a minimum.

The method 500 may then include approximating the reactive torque effect, as at 514. By way of explanation, positive displacement motors turn the bit clockwise but produce counter-clockwise "reactive" torque with increasing WOB. Reactive torque increases with increasing WOB until it reaches a maximum when the motor stalls. This, e.g., counter-clockwise torque affects motor orientation when it is used in steerable applications. Thus, this effect is taken into account when orienting the motor's tool-face from surface. General estimates can be made using "drill string twist" tables and differential pressure measurements.

With these parameters calculated, the method 500 may proceed to correcting the trajectory of the BHA 130, when such correction is called for. Accordingly, the method 500 may include determining whether the BHA 130 is on target, as at 516. The determination of whether the BHA is on target may be conducted using MWD devices, gyroscopes, etc., which may allow sensing of the orientation of the BHA 130.

If the BHA 130 is not on target (i.e., result of 516 is 'NO'), the method 500 may determine in which direction the BHA 130 is steering off course. For example, the method 500 may determine whether the BHA 130 is steering toward a first direction (e.g., the left), as at 518. It will be readily appreciated that this determination could be substituted with a determination of whether the BHA 130 is steering to a second direction (e.g., right). If the BHA 130 is steering to the second direction (e.g., right; determination at 518 is 'YES'), the method 500 may proceed to "shaking" the drill string 104, e.g., by varying the hookload so as to generate axial vibrations in the drill string 104 that oscillate the WOB. This shaking may proceed until the differential pressure is greater than the differential pressure experienced at the minimum WOB. Such greater differential pressure may cause the BHA 130 to steer toward the first direction (e.g., left).

By way of a brief explanation, when drilling fluid is forced through the power section of a positive displacement motor, the pressure drop causes the rotor to turn inside of the stator. This provides a broad range of bit speeds and torque outputs for satisfying the plurality of various drilling applications. In general, increasing WOB increases both differential pressure and torque. Similarly, reducing WOB decreases differential pressure and torque. Consequently, a drilling rig's pressure gauge and WOB indicator can be used to monitor mud motor performance over time. Because drag can impair weight transference to the motor, drag-reducing down-hole tools may be included as part of the drill-string in order to maintain an operating range between applied WOB and differential pressure. Compromising the ratio of WOB and differential pressure with excessive WOB can stall the motor and/or damage the on-bottom thrust bearings of the same. The effectiveness of the aforementioned drag-reducing down-hole tools depends on mud-weight, flow rate, tortuosity (tight spots), BHA selection, mechanical safeguards (e.g., "Safety Joint"), rotary speed, etc. Shaking the drill-string, systematically, from surface can be triggered automatically when differential pressure falls below the expected threshold for a specific WOB range. Shaking of the drill-string can be stopped automatically when weight transference improves and differential pressure rises above or near the expected threshold for the specific WOB range.

Returning to FIG. 5, if the determination is that the BHA 130 is steering to a second direction (e.g., right; i.e., block 518 yields 'NO'), the method 500 may proceed to increasing the hookload, as at 522, e.g., until the differential pressure is less than the differential pressure at the hookload minimum. This may cause the BHA 130 to steer to the first direction (e.g., left).

After shaking at 520 or increasing hookload at 522, the method 500 may proceed back to determining whether the BHA 130 is on target at 516. If still not on target, the method 500 may proceed back to shaking or adding hookload, as appropriate. Otherwise (e.g., determination at 516 is 'YES'), the method 500 may proceed to determining whether the ROP is below a predetermined threshold, as at 524. Directional well plans are generally specified to maximize rotary drilling and minimize slide drilling. This may serve to reduce the amount of non-productive time (NPT) associated with orienting tool-face and increase the overall ROP by virtue of diluting the generally lower sliding ROP. During slide drilling, reaching and maintaining an acceptable ROP is may be difficult as consequence of the inconsistent transfer of weight from surface to the bit. This may be amplified as drag increases causing sliding ROP reductions in excess of about 75% from rotary ROP.

If the ROP falls below the aforementioned threshold, or otherwise considered to be low, the determination at 524 may be 'YES', and the method 500 may proceed to shaking the drill string 104, as at 526. In this case, the shaking may be conducted until the differential pressure is equal to the differential pressure at the hookload minimum.

If ROP meets or exceeds the threshold, or after shaking at 526, the method 500 may proceed back to again calculating the drag of the drill string in the wellbore 106, e.g., after the BHA 130 has advanced. This may be a continuous iterative loop, or the method 500 may wait for a trigger or a period of time before returning to block 506. Once having returned to block 506, the method 500 may then proceed back through the sequence of calculations, determinations, shaking, etc.

Figure 6:
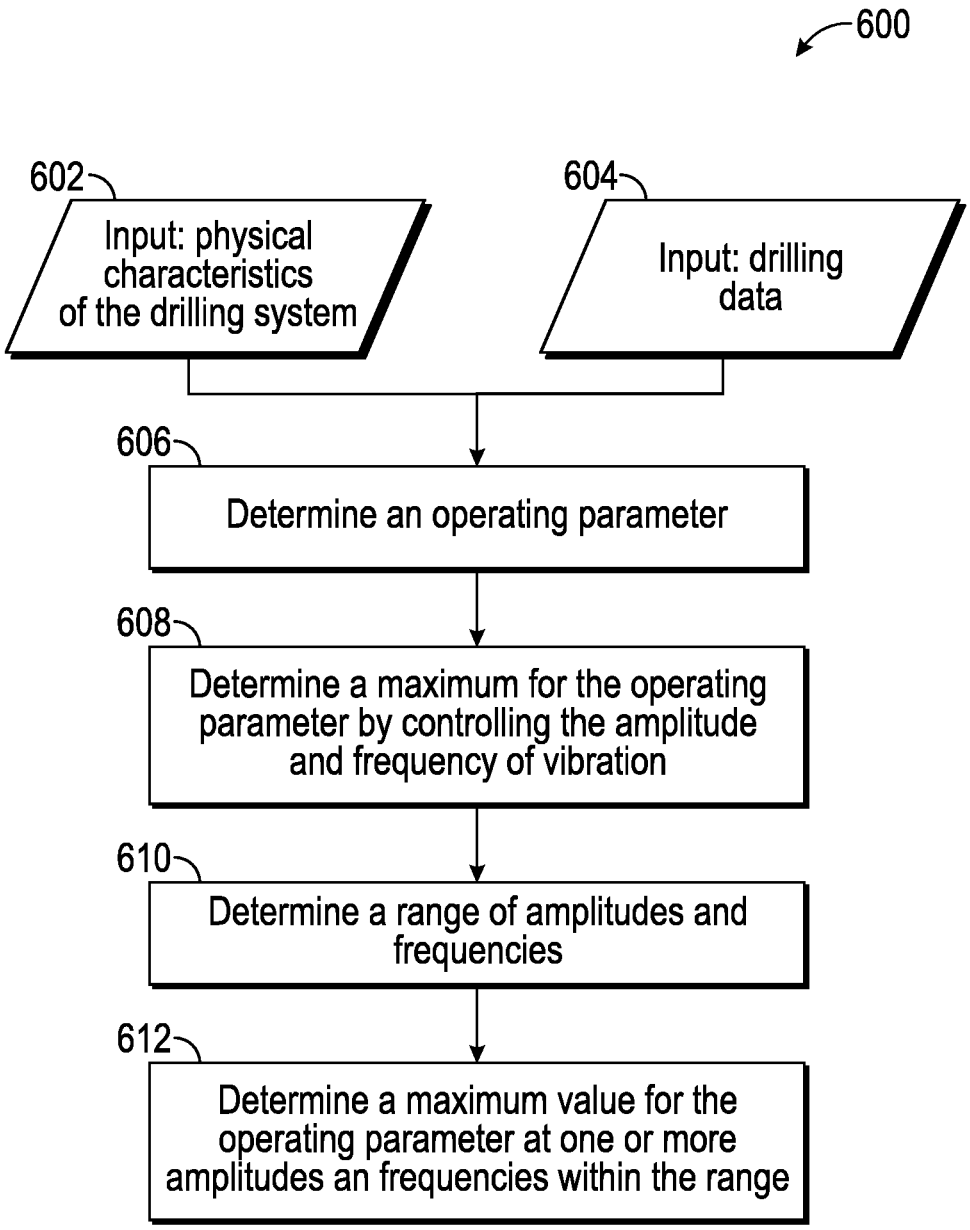

FIG. 6 illustrates a flowchart of another method 600 for drilling, according to an embodiment. One or more embodiments of the method 600 may be executed by an embodiment of the drilling system 100, and thus will be described with reference thereto; however, at least some embodiments of the method 600 may be executed using other types of drilling systems.

The method 600 may begin by receiving inputs at 602 and 604. In particular, at 602, the method 600 may receive physical characteristics of the drilling system 100. Such physical characteristics may include physical characteristics of the equipment of the drilling system 100, the pipe and/or tools of the drill string 104, the BHA 130, well trajectory, formation characteristics, etc. The method 600 may also include receiving drilling data, e.g., in real-time during drilling operations, from sensors of the drilling system 100, whether located at the top surface or downhole. Such drilling data may include WOB, surface torque, stand pipe pressure, motor differential pressure, ROP, motor toolface, well survey, well depth, etc.

The method 600 may then proceed to determining an operating parameter, as at 606. The operating parameter 606 may be based on one or more subparameters including: the rate of penetration, hole cleaning index, bit balling index, toolface hold success ratio, differential sticking index, and/or the like. In some embodiments, each of the included subparameters (which may be a subset of the listed subparameters and/or other factors) may be normalized (ranging from 0 to 1, for example) and then assigned a weight (e.g., such that the total of the weights sums to 1). The operating parameter may then be established as a combination (e.g., summation) of the weighted, normalized subparameters. The method 600 may then determine a maximum for the operating parameter by controlling the amplitude and frequency of vibration, e.g., axial vibration caused by varying the hookload, as at 608.

The method 600 may further include determining a range of amplitudes and frequencies for the axial vibration, as at 610. This range may be calculated based on the physical characteristics of the drilling system 100, as obtained at 602. For example, the range may depend on buckling limit of the drill string 104, operating limits of the tubular and connections, surge and swab limits, etc.

The method 600 may then include determining a maximum value for the operating parameter at one or more amplitudes within the range, as at 612.

In one or more embodiments, the functions described can be implemented in hardware, software, firmware, or any combination thereof. For a software implementation, the techniques described herein can be implemented with modules (e.g., procedures, functions, subprograms, programs, routines, subroutines, modules, software packages, classes, and so on) that perform the functions described herein. A module can be coupled to another module or a hardware circuit by passing and/or receiving information, data, arguments, parameters, or memory contents. Information, arguments, parameters, data, or the like can be passed, forwarded, or transmitted using any suitable means including memory sharing, message passing, token passing, network transmission, and the like. The software codes can be stored in memory units and executed by processors. The memory unit can be implemented within the processor or external to the processor, in which case it can be communicatively coupled to the processor via various means as is known in the art.

Figure 7:
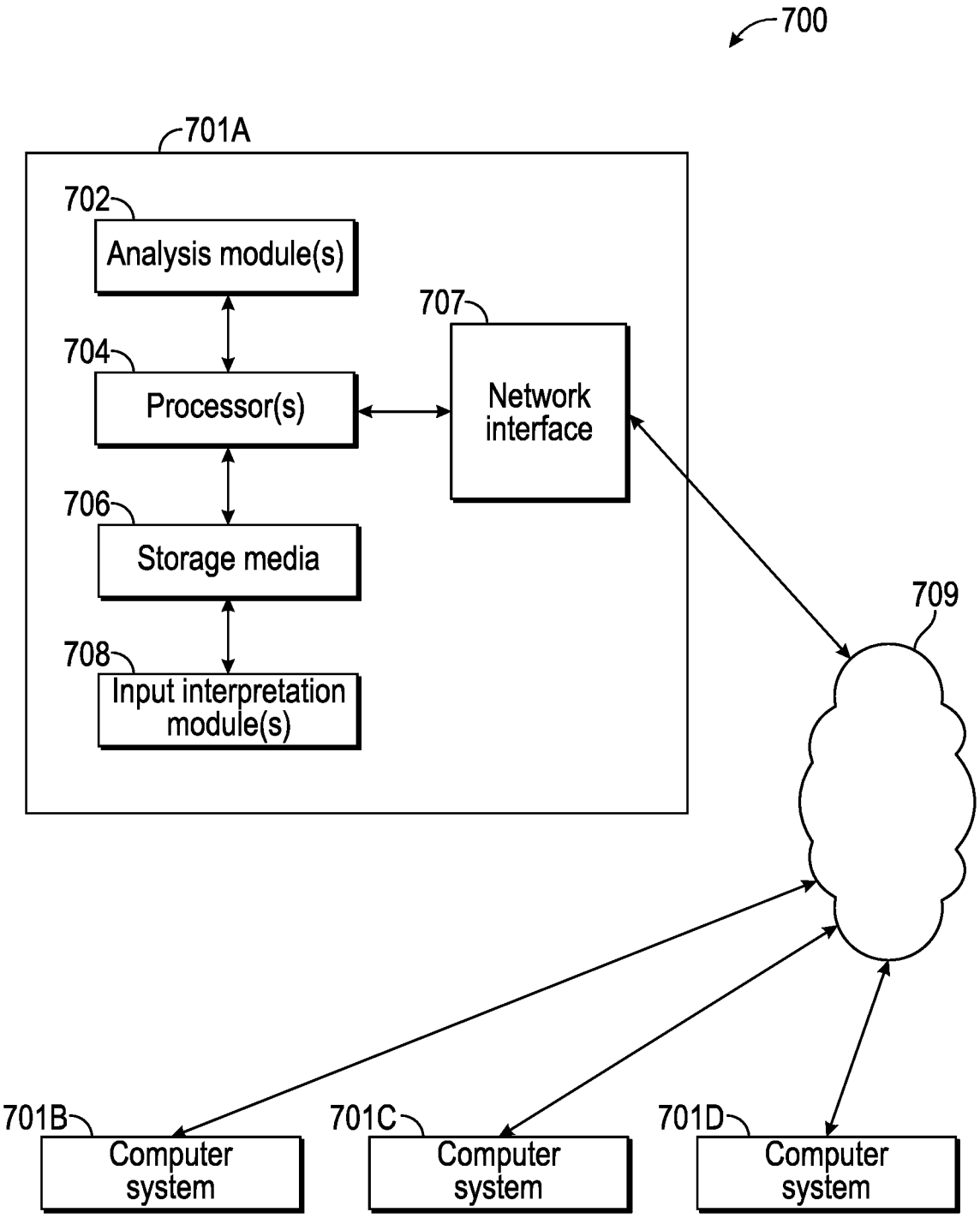
FIG. 7 illustrates a schematic view of a computing system, according to an embodiment.

In some embodiments, any of the methods of the present disclosure may be executed by a computing system. FIG. 7 illustrates an example of such a computing system 700, in accordance with some embodiments. The computing system 700 may include a computer or computer system 701A, which may be an individual computer system 701A or an arrangement of distributed computer systems. The computer system 701A includes one or more analysis module(s) 702 configured to perform various tasks according to some embodiments, such as one or more methods disclosed herein. To perform these various tasks, the analysis module 702 executes independently, or in coordination with, one or more processors 704, which is (or are) connected to one or more storage media 706. The processor(s) 704 is (or are) also connected to a network interface 707 to allow the computer system 701A to communicate over a data network 709 with one or more additional computer systems and/or computing systems, such as 701B, 701C, and/or 701D (note that computer systems 701B, 701C and/or 701D may or may not share the same architecture as computer system 701A, and may be located in different physical locations, e.g., computer systems 701A and 701B may be located in a processing facility, while in communication with one or more computer systems such as 701C and/or 701D that are located in one or more data centers, and/or located in varying countries on different continents).

A processor can include a microprocessor, microcontroller, processor module or subsystem, programmable integrated circuit, programmable gate array, or another control or computing device.

The storage media 706 can be implemented as one or more computer-readable or machine-readable storage media. Note that while in the example embodiment of FIG. 7 storage media 706 is depicted as within computer system 701A, in some embodiments, storage media 706 may be distributed within and/or across multiple internal and/or external enclosures of computing system 701A and/or additional computing systems. Storage media 706 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLU-RAY® disks, or other types of optical storage, or other types of storage devices. Note that the instructions discussed above can be provided on one computer-readable or machine-readable storage medium, or alternatively, can be provided on multiple computer-readable or machine-readable storage media distributed in a large system having possibly plural nodes. Such computer-readable or machine-readable storage medium or media is (are) considered to be part of an article (or article of manufacture). An article or article of manufacture can refer to any manufactured single component or multiple components. The storage medium or media can be located either in the machine running the machine-readable instructions, or located at a remote site from which machine-readable instructions can be downloaded over a network for execution.

In some embodiments, computing system 700 contains one or more survey module(s) 708. In the example of computing system 700, computer system 701A includes the survey module 708. In some embodiments, a single survey module may be used to perform at least some aspects of one or more embodiments of the methods. In other embodiments, a plurality of survey modules may be used to perform at least some aspects of methods.

It should be appreciated that computing system 700 is only one example of a computing system, and that computing system 700 may have more or fewer components than shown, may combine additional components not depicted in the example embodiment of FIG. 7, and/or computing system 700 may have a different configuration or arrangement of the components depicted in FIG. 7. The various components shown in FIG. 7 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of protection of the invention.

Geologic interpretations, models and/or other interpretation aids may be refined in an iterative fashion; this concept is applicable to embodiments of the present methods discussed herein. This can include use of feedback loops executed on an algorithmic basis, such as at a computing device (e.g., computing system 700, FIG. 7), and/or through manual control by a user who may make determinations regarding whether a given step, action, template, model, or set of curves has become sufficiently accurate for the evaluation of the subsurface three-dimensional geologic formation under consideration.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods are illustrated and described may be re-arranged, and/or two or more elements may occur simultaneously. The embodiments were chosen and described in order to best explain the principals of the invention and its practical applications, to thereby enable others skilled in the art to best utilize the various embodiments with various modifications as are suited to the particular use contemplated.

What is claimed is:

1. A method for drilling, comprising:

receiving a drilling model of a drilling system comprising:

a drilling device coupled to a surface structure;

a drill string coupled to the drilling device and extending therefrom into a wellbore, the drill string comprising a motor;

a drawworks;

a drilling line connected to the drawworks and the drilling device, such that the drawworks is configured to raise and lower the drilling device;

an actuator connected to the drilling link and the surface structure;

selecting a frequency and amplitude for an axial vibration of the drill string based on the drilling model;

and generating the axial vibration of the drill string substantially at the frequency and the amplitude selected, wherein the axial vibration is selectively and automatically introduced at the surface structure in response to the drilling string being in sliding mode, by one or more of:

modulating a hookload; and introducing an axial movement pattern.

2. The method of claim 1, wherein selecting the frequency and amplitude comprises selecting a frequency and amplitude for oscillations of weight-on-bit.

3. The method of claim 1, further comprising:

measuring a performance characteristic while generating the axial vibration;

selecting a second frequency and a second amplitude;

generating the axial vibration at the second frequency and second amplitude;

measuring the performance characteristic while generating the axial vibration at the second frequency and the second amplitude; and determining whether to adjust the frequency, the amplitude, or both based on the performance characteristic.

4. The method of claim 1, further comprising:

determining a first toolface orientation for the drill string before generating the axial vibration;

determining a second toolface orientation for the drill string after generating the axial vibration; and adjusting the frequency, amplitude, or both of the axial vibration based on a difference between the first and second toolface orientations.

5. The method of claim 1, further comprising:

calculating a hookload maximum and minimum for the drilling system based on the drilling model;

determining an envelope for the frequency and amplitude of the axial vibration based on the hookload maximum and the hookload minimum.

6. The method of claim 1, further comprising:

determining that a bottom-hole assembly of the drill string is steering to a first direction, wherein the axial vibration is generated in response to determining that the bottom-hole assembly of the drill string is steering to the first direction.

7. The method of claim 6, further comprising:

determining that the bottom-hole assembly is steering to a second direction; and in response to determining that the bottom-hole assembly is steering to the second direction, increasing the hookload.

8. A system for drilling, comprising:

a surface structure;

a drilling device coupled to the surface structure;

a drill string coupled to the drilling device and extending therefrom into a wellbore, the drill string comprising a motor;

a drawworks;

a drilling line connected to the drawworks and the drilling device, such that the drawworks is configured to raise and lower the drilling device;

an actuator connected to the drilling line and the surface structure, wherein the actuator is configured to vertically oscillate a position of the drilling device and cause axial vibration in the drill string; and a processor coupled to the actuator, wherein the processor is configured to select a frequency and an amplitude for axial vibration in the drill string, wherein the processor is configured to detect the drilling string being in sliding mode, wherein the processor automatically transmits signals to the actuator, causing the actuator to generate the axial vibration in the drill string, in response to the processor determining that the drilling string is in sliding mode.

9. The system of claim 8, wherein selecting the frequency and amplitude comprises selecting a frequency and amplitude for oscillations of weight-on-bit.

10. The system of claim 8, wherein the processor is further configured to perform operations comprising:

measuring a performance characteristic while generating the axial vibration;

selecting a second frequency and a second amplitude;

generating the axial vibration at the second frequency and second amplitude;

measuring the performance characteristic while generating the axial vibration at the second frequency and the second amplitude; and determining whether to adjust the frequency, the amplitude, or both based on the performance characteristic.

11. The system of claim 8, wherein the processor is further configured to perform operations comprising:

determining a first toolface orientation for the drill string before generating the axial vibration;

determining a second toolface orientation for the drill string after generating the axial vibration; and adjusting the frequency, amplitude, or both of the axial vibration based on a difference between the first and second toolface orientations.

12. The system of claim 8, wherein the processor is further configured to perform operations comprising:

calculating a hookload maximum and minimum for the drilling system based on the drilling model;

determining an envelope for the frequency and amplitude of the axial vibration based on the hookload maximum and the hookload minimum.

13. The system of claim 8, wherein the processor is further configured to perform operations comprising:

determining that a bottom-hole assembly of the drill string is steering to a first direction, wherein the axial vibration is generated in response to determining that the bottom-hole assembly of the drill string is steering to the first direction.

14. The system of claim 13, wherein the processor is further configured to perform operations comprising:

determining that the bottom-hole assembly is steering to a second direction; and in response to determining that the bottom-hole assembly is steering to the second direction, increasing the hookload.

15. A non-transitory, computer-readable medium storing instructions that, when executed by at least one processor of a computing system, causing the computing system to perform operations, the operations comprising:

receiving a drilling model of a drilling system comprising:

a drilling device coupled to a surface structure;

a drill string coupled to the drilling device and extending therefrom into a wellbore, the drill string comprising a motor;

a drawworks;

a drilling line connected to the drawworks and the drilling device, such that the drawworks is configured to raise and lower the drilling device;

an actuator connected to the drilling link and the surface structure;

selecting a frequency and amplitude for an axial vibration of the drill string based on the drilling model; and causing the actuator to generate the axial vibration of the drill string substantially at the frequency and the amplitude selected, wherein the axial vibration is selectively and automatically introduced at the surface structure in response to the drilling string being in sliding mode, by one or more of:

modulating a hookload; and introducing an axial movement pattern for execution by a downhole vibrator.

16. The medium of claim 15, wherein selecting the frequency and amplitude comprises selecting a frequency and amplitude for oscillations of weight-on-bit.

17. The medium of claim 16, wherein the operations further comprise:

measuring a performance characteristic while generating the axial vibration;

selecting a second frequency and a second amplitude;

generating the axial vibration at the second frequency and second amplitude;

measuring the performance characteristic while generating the axial vibration at the second frequency and the second amplitude; and determining whether to adjust the frequency, the amplitude, or both based on the performance characteristic.

18. The medium of claim 15, wherein the operations further comprise:

determining a first toolface orientation for the drill string before generating the axial vibration;

determining a second toolface orientation for the drill string after generating the axial vibration; and adjusting the frequency, amplitude, or both of the axial vibration based on a difference between the first and second toolface orientations.

19. The medium of claim 15, wherein the operations further comprise:

calculating a hookload maximum and minimum for the drilling system based on the drilling model;

determining an envelope for the frequency and amplitude of the axial vibration based on the hookload maximum and the hookload minimum.

20. The medium of claim 15, wherein the operations further comprise:

determining that a bottom-hole assembly of the drill string is steering to a first direction, wherein the axial vibration is generated in response to determining that the bottom-hole assembly of the drill string is steering to the first direction.

* * * * *